US008740027B2

(12) United States Patent
Manor et al.

(10) Patent No.: US 8,740,027 B2
(45) Date of Patent: Jun. 3, 2014

(54) BACKPACK FOR FILTER BAG USED IN COMBINATION WITH A PNEUMATIC SANDER

(75) Inventors: Edward L. Manor, Lakeland, MN (US); Nicholas B. Manor, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 32 days.

(21) Appl. No.: 13/320,692

(22) PCT Filed: May 17, 2010

(86) PCT No.: PCT/US2010/035061
§ 371 (c)(1), (2), (4) Date: Nov. 15, 2011

(87) PCT Pub. No.: WO2010/147725
PCT Pub. Date: Dec. 23, 2010

(65) Prior Publication Data

US 2012/0061438 A1 Mar. 15, 2012

Related U.S. Application Data

(60) Provisional application No. 61/187,481, filed on Jun. 16, 2009.

(51) Int. Cl.
*A45C 15/00* (2006.01)
*A47L 5/36* (2006.01)

(52) U.S. Cl.
USPC ..... 224/576; 224/627; 15/327.5

(58) Field of Classification Search
USPC ..... 224/576, 264, 257, 259, 263, 600, 623, 224/627–9, 637, 645, 654, 160; 30/275.4, 30/160; 15/324, 327.5, 347, 340.1, 340.2, 15/143.1, 339; 451/352, 357, 459, 87, 90; 16/246; 55/385.1, 467
See application file for complete search history.

(56) References Cited

U.S. PATENT DOCUMENTS

| | | | | |
|---|---|---|---|---|
| 2,563,195 | A * | 8/1951 | Soule et al. | 144/104 |
| 4,074,839 | A * | 2/1978 | Wood et al. | 224/635 |
| 4,213,276 | A | 7/1980 | Jennings | |
| 4,921,143 | A * | 5/1990 | Billet | 222/175 |
| 5,011,058 | A * | 4/1991 | Sapp et al. | 224/261 |

(Continued)

FOREIGN PATENT DOCUMENTS

| | | |
|---|---|---|
| DE | 85 16 418 U1 | 10/1986 |
| DE | 10 2006 04945 | 4/2008 |

(Continued)

OTHER PUBLICATIONS

ASTM D-737-04 (reapproved 2008) "Standard Test Method for Air Permeability of Textile Fabrics", pp. 1-5.

(Continued)

*Primary Examiner* — Justin Larson
*Assistant Examiner* — Phillip Schmidt
(74) *Attorney, Agent, or Firm* — Scott A. Baum

(57) ABSTRACT

A backpack for use in combination with a filter bag and a pneumatic sanding tool is described. The backpack comprises a backpack strap, a back panel, and an opening or a first mesh panel located in the back panel. The opening or the first mesh panel is positioned to direct exhaust air from the filter bag onto a person's back during use.

15 Claims, 1 Drawing Sheet

(56) References Cited

U.S. PATENT DOCUMENTS

| | | | | |
|---|---|---|---|---|
| 5,133,300 | A * | 7/1992 | Miura | 123/2 |
| 5,655,374 | A * | 8/1997 | Santilli et al. | 62/3.5 |
| 6,030,464 | A * | 2/2000 | Azevedo | 134/6 |
| 6,047,668 | A * | 4/2000 | Yamamoto et al. | 123/2 |
| 6,049,941 | A * | 4/2000 | Vollenweider, II | 15/327.5 |
| 6,073,301 | A * | 6/2000 | Berfield | 15/327.5 |
| RE37,081 | E | 3/2001 | Eriksen | |
| 6,240,596 | B1 | 6/2001 | Kiern | |
| 6,283,347 | B1 * | 9/2001 | Roh | 224/160 |
| 6,969,310 | B1 | 11/2005 | Ghilardi | |
| 7,056,198 | B2 | 6/2006 | Xmith | |
| 2003/0070250 | A1 * | 4/2003 | Roy et al. | 15/327.5 |
| 2003/0127060 | A1 * | 7/2003 | Yeung | 119/497 |
| 2003/0205601 | A1 * | 11/2003 | Kilduff | 224/627 |
| 2005/0086762 | A1 | 4/2005 | Paris | |
| 2005/0205634 | A1 | 9/2005 | Sang | |
| 2006/0191270 | A1 * | 8/2006 | Warren | 62/3.3 |
| 2007/0044270 | A1 * | 3/2007 | Crevling et al. | 15/327.5 |
| 2007/0209141 | A1 | 9/2007 | Hare | |
| 2008/0172826 | A1 * | 7/2008 | Rappin | 15/405 |
| 2008/0277433 | A1 * | 11/2008 | Karl et al. | 224/148.6 |
| 2009/0056548 | A1 | 3/2009 | Woo | |
| 2009/0095780 | A1 * | 4/2009 | Wangeby et al. | 224/262 |
| 2010/0155447 | A1 * | 6/2010 | Zheng et al. | 224/576 |
| 2010/0197211 | A1 * | 8/2010 | Guth | 451/456 |
| 2010/0252594 | A1 * | 10/2010 | Basenberg et al. | 224/259 |
| 2010/0282810 | A1 * | 11/2010 | Hawes | 224/653 |

FOREIGN PATENT DOCUMENTS

| | | | | |
|---|---|---|---|---|
| JP | 2004-147871 | | 5/2004 | |
| WO | WO 9427485 | A1 * | 12/1994 | A47L 5/36 |
| WO | WO2006/068072 | | 6/2006 | |
| WO | 2010/074774 | | 7/2010 | |

OTHER PUBLICATIONS

EPO Communication—Extended European Search Report, Dec. 9, 2013.

* cited by examiner

BACKPACK FOR FILTER BAG USED IN COMBINATION WITH A PNEUMATIC SANDER

CROSS REFERENCE TO RELATED APPLICATIONS

This application is a national stage filing under 35 U.S.C. 371 of PCT/US2010/35061, filed May 17, 2010, which claims priority to U.S. Provisional Patent Application No. 61/187,481, filed Jun. 16, 2009, the disclosures of which are incorporated by reference in their entirety herein.

BACKGROUND

Abrasive articles are useful for a variety of grinding and finishing applications. Often the abrasive articles are used in combination with portable pneumatic sanders. Various models of pneumatic sanders include a vacuum feature that can suck up dust from the work surface and transport the debris to another location for containment. This vacuum feature can be self-generated by use of a venturi in combination with a source of compressed air that is used to power the air motor of the pneumatic sander. In many applications, it is desirable to contain the dust in a filter bag relatively close to the sanding tool instead of transporting the dust through hoses and ducts to a central collection location.

SUMMARY

It has been determined that a backpack in combination with a filter bag and a vacuum hose can be used to conveniently collect and store dust and debris generated by sanding operations while an operator is working. However, typical backpacks suffer from several problems when used to hold a filter bag for a pneumatic sanding tool. First, the permeability of a typical cloth backpack is insufficient to adequately vent the 15-20 cfm of self-generated exhaust air produced by some pneumatic sanders during use. This can result in the backpack expanding like a balloon possibly even causing the backpack to rupture. The expanded backpack is uncomfortable to wear and significantly tightens the straps about the torso of the wearer once it expands. Furthermore, such a restriction in the exhaust airflow can impede the filter bag's efficiency and/or affect the performance of the pneumatic sander.

Second, conventional backpacks are not designed for proper air management when used in combination with a pneumatic sanding tool and a filter bag. The exhaust air can leak out various seams or zippers. The airflow can be directed at a person's neck, head, or face thereby being undesirable or objectionable by operators under certain conditions.

Third, a backpack when worn in a hot environment for extended periods of time can become quite uncomfortable. The backpack resting against a person's back can reduce evaporation through a person's cloths thereby leading to the collection of sweat on the backpack and on the wearer's clothing reducing operator comfort.

The present invention solves the above problems and others by placing at least one opening or mesh panel into the backpack to vent exhaust air. In some embodiments, a first mesh panel is located in a back panel of the backpack adjacent to the wearer's back to direct exhaust air onto the wearer's back thereby helping to improve operator comfort in use and to reduce or eliminate sweaty clothing. In some embodiments, the first mesh panel directing airflow to the wearer's back can be selectively opened or closed to suit the operator's preference and to adjust the amount of airflow. In other embodiments, a second mesh panel is located in the lower half of the backpack to ensure exhaust air is directed away from the head and neck of the wearer when the first mesh panel is closed. In other embodiments, the material used to make the backpack comprises a low air permeability or air impermeable material such that the exhaust air is primarily exhausted through the mesh panels resulting in improved exhaust air management from the backpack.

Hence in one embodiment, the invention resides in a backpack for use in combination with a filter bag. The backpack comprises a backpack strap, a back panel, and an opening or a first mesh panel located in the back panel. The opening or the first mesh panel is positioned to direct exhaust air from the filter bag onto a person's back during use.

DESCRIPTION OF THE DRAWINGS

It is to be understood by one of ordinary skill in the art that the present discussion is a description of exemplary embodiments only, and is not intended as limiting the broader aspects of the present invention, which broader aspects are embodied in the exemplary construction.

Figure 1:
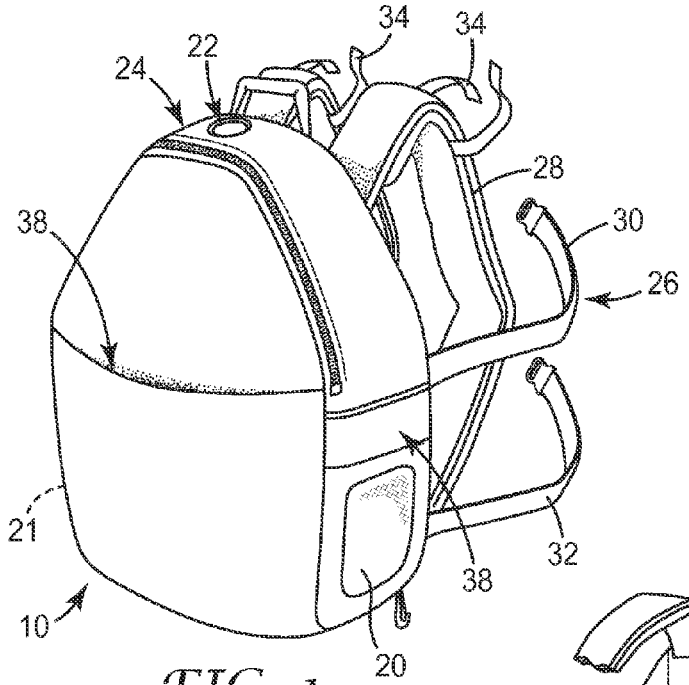
FIG. 1 illustrates a perspective view of a backpack for use with a pneumatic sander and a filter bag.

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, a "backpack" means a pouch or bag intended to be worn over the back of the wearer during use. The backpack may have one or more shoulder straps to secure the backpack during use. Some backpacks have two shoulder straps to secure the backpack, while others provide only a single shoulder strap. Alternatively, the backpack may include only a waist strap for securing the backpack. Backpacks with only a waist strap are commonly referred to as fanny packs. A fanny pack is a species of the genius of backpacks.

DETAILED DESCRIPTION

Figure 2:
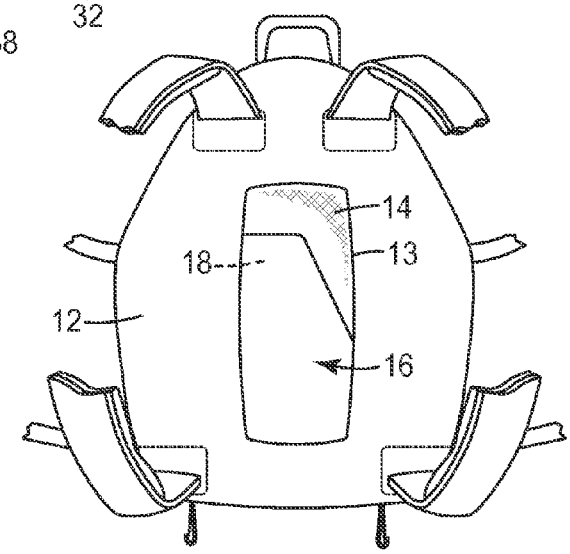
FIG. 2 illustrates a rear view of the backpack of FIG. 1.
Figure 3:
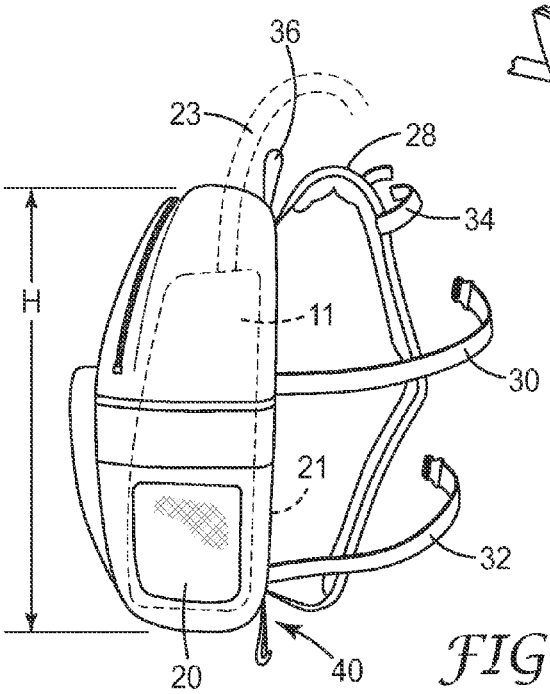
FIG. 3 illustrates a side view of the backpack of FIG. 1.

Referring to FIGS. 1, 2, and 3, various views of a backpack 10 for use with a pneumatic sander and a filter bag 11 are shown. The backpack 10 comprises a back panel 12 that is positioned adjacent the wearer's back when the backpack is worn by the operator. The back panel 12 typically rests against a person's back when the backpack 10 is worn. The back panel 12 comprises an opening 13 for directing exhaust air from the interior of the backpack onto the wearer's back during use to cool the operator. In some embodiments, the opening 13 comprises a first mesh panel 14. The first mesh panel 14 can comprise a separate mesh panel that is positioned within or connected to the back panel 12. Alternatively, the first mesh panel 14 can be integral with the back panel 12 and formed by cutting, slitting, or punching a plurality of apertures into the back panel 12. The first mesh panel 14 can be made of a mesh fabric material, netting, screening, or other material having a plurality of apertures, slits, or openings in the material permitting significant airflow from inside the backpack through the mesh panel. In one embodiment, the first mesh panel 14 comprised black #SHR699 polyester mesh, medium soft finish, raschel knit, with approximately 60-70% open area and weighing approximately 7.8 oz./sq. yd.

The first mesh panel 14 is positioned to direct exhaust air from inside the backpack 10, after being filtered by the filter bag 11, onto the wearer's back during sanding operations when the pneumatic sander is in use. By directing the exhaust airflow onto the wearer's back, operator comfort can be increased in hot or humid environmental conditions thereby helping to cool the operator. The directed exhaust airflow can reduce sweat accumulation on the wearer's clothing or the back panel 12 when wearing the backpack for extended periods of time.

In some embodiments, the backpack 10 includes a flow control device 16 for controlling the volume of exhaust air directed onto the wearer's back. The flow control device 16 can comprise a flap 18 positioned either on the interior or exterior surface of the back panel 12 and over the first mesh panel 14 to reduce or eliminate exhaust airflow through the first mesh panel. The flap 18 can be secured in an open position, or in a closed position, or in both positions by one or more fasteners used individually or in combination such as hook and loop materials, buttons, snaps, zippers, cam locks, pins, or other suitable fastener. Thus, the flap 18 can be selectively opened or closed to allow or restrict exhaust airflow onto the wearer's back.

In one embodiment, the top and two sides of the interior surface of the back panel 12 adjacent the opening 13 were surrounded with a hook material and the flap 18 was sewn to the interior surface of the back panel 12 adjacent to the bottom of the opening 13. The top and two sides of the flap 18 were provided with a loop material. In this manner, the flap 18 could be secured to the interior surface of the back panel 12 in a closed position or in intermediate positions that exposed more of the first mesh panel 14.

In other embodiments, the flow control device 16 can comprise a zipper within a panel overlaying the first mesh panel 14 and positioned on the interior or exterior surface of the back panel 12. The zipper can be progressively opened to increase exhaust airflow onto the wearer's back. Alternatively, a zipper can be located along either side of the flap 18 to progressively expose more of the mesh panel. In yet further embodiments, the flow control device 16 can comprise a sliding panel positioned on the interior or exterior surface of the back panel 12 for progressively opening more of the first mesh panel 14 to increase the exhaust airflow onto the wearer's back. Other suitable flow control devices can be used to restrict the exhaust airflow through the first mesh panel 14.

In some embodiments, the backpack 10 includes a second mesh panel 20. The second mesh panel 20 can be positioned anywhere in the backpack. The second mesh panel 20 can be provided to exhaust airflow from the backpack 10 when the first mesh panel 14 is closed or restricted by the flow control device 16 thereby continuing to provide an exhaust airflow path having a relatively low pressure drop. In some embodiments, the second mesh panel 20 is located in the lower ½ of the backpack's overall height H. By locating the second mesh panel 20 in the lower ½ of the backpack's height, exhaust airflow is directed away from the wearer's neck or head during use. If desired, additional mesh panels for exhausting airflow from the backpack can be included. For example, a third mesh panel 21 can be positioned opposite the second mesh panel 20 in the opposing side panel of the backpack 10. Alternatively, a mesh panel can be located in the backpack's front panel, which opposes the back panel 12.

The second mesh panel 20, and any additional mesh panels in the backpack, can utilize the previously discussed flow control device 16 to adjust the volume of air exhausted through the mesh panel. For example, airflow through the second mesh panel 20 can be closed off by the flow control device 16 thereby directing all exhaust air onto the wearer's back. Alternatively, the first mesh panel 14 can be closed off and all the airflow exhausted through the second mesh panel 20. In yet another embodiment, the exhaust airflow can be proportioned between the first mesh panel 14 and the second mesh panel 20.

In order to prevent the backpack from unduly expanding due to the high volume of exhaust air, the open area of the opening 13 or of the mesh panels can be controlled. Desirably, a sufficiently large open area is present so as to freely exhaust air from the filter bag 11 within the backpack 10. However, creating too large of an open area or mesh panel can reduce the strength of the backpack and possibly direct the airflow in unwanted directions. In some embodiments of the invention, the open area as represented by the area of the opening 13 or the total area of the openings within the mesh panels can be at least about 20 $cm^2$, or between about 20 $cm^2$ to about 1,000 $cm^2$, or between about 20 $cm^2$ to about 500 $cm^2$.

In other embodiments of the invention, the air permeability of the mesh panels can be controlled to ensure adequate exhaust air flow through the mesh panels. The air permeability of the material forming the mesh panels as tested by ASTM D-737-04 (reapproved 2008) Standard Test Method for Air Permeability of Textile Fabrics can be greater than about 250 $ft^3/min/ft^2$, or greater than about 500 $ft^3/min/ft^2$, or greater than about 750 $ft^3/min/ft^2$.

In various embodiments, the material used to make the backpack 10, other than the mesh panels, comprises a low permeability material or is substantially impermeable to airflow. The low air permeability can be created by the choice of the material used to make the backpack, or the material can be coated or treated to reduce its air permeability. By forming the remaining portions of the backpack from a material restrictive to airflow, it is possible to direct the airflow within the backpack as necessary. This helps to ensure most of the exhaust air is vented through the mesh panels rather than through the material forming the remaining portion of the backpack 10. In this manner, improved efficiency of the filter bag 11 can result and the exhaust air is directed away from the wearer's body unless so desired by the wearer. In some embodiments of the invention, the air permeability of the material forming the backpack as tested by ASTM D-737-04 (reapproved 2008) Standard Test Method for Air Permeability of Textile Fabrics can be less than about 100 $ft^3/min/ft^2$, or less than about 50 $ft^3/min/ft^2$ or less than about 10 $ft^3/min/ft^2$, or less than about 5 $ft^3/min/ft^2$, or 0 $ft^3/min/ft^2$ (impermeable). In one embodiment, the material used to make the bag portion of the backpack 10, other than the mesh panels, comprised a black 600 denier polyester fabric coated with polyvinyl chloride (pvc) having an air permeability as tested by ASTM D-737-04 of 0 $ft^3/min/ft^2$.

The backpack 10 can further include a vacuum hose aperture 22 for passing a vacuum hose 23 directly into the interior of the backpack or for positioning a coupling within the vacuum hose aperture to fluidly connect the vacuum hose 23 to the filter bag 11 within the backpack. Desirably, the vacuum hose aperture 22 is sealed or sized appropriately to reduce or eliminate exhaust air from leaking out of the vacuum hose aperture. In some embodiments, the vacuum hose aperture 22 is located in the upper ½ of the backpack's height, H, or even in a top panel 24 of the backpack 10.

By positioning the vacuum hose aperture 22 in this manner several benefits can accrue. First, the filter bag 11 can be located lower in the backpack 10 helping with weight distribution when collecting large amounts of dust and debris. Second, the dust and debris can be assisted by gravity to the lowermost portion of the filter bag 11 as sanding progresses and the filter bag begins to fill up. Third, the vacuum hose 23 can be conveniently routed up and over the shoulder of the wearer and then secured to a backpack strap 26, such as a shoulder strap 28, a chest strap 30, or a waist strap 32, by a vacuum hose strap 34. By securing the vacuum hose 23 to the shoulder strap 28 that goes over the shoulder of the operator, the vacuum hose is prevented from snagging undesirably, and it is routed more in line with the operator's arm and hand bringing the hose closer to the sanding tool where the other end is attached. In one embodiment, the vacuum hose strap 34 attached to the backpack strap 26 comprised approximately ½ of its length as strap hook material and ½ of its length as strap loop material such that the opposing ends of the vacuum hose strap 34 could be connected to each other.

In embodiments of the invention, the backpack 10 can include a lifting handle 36, the shoulder strap 28, the chest strap 30, and the waist strap 32 attached to their respective regions of the backpack. Alternatively, opposing ends of the chest strap 30 can be connected to the shoulder straps 28. The backpack 10 can include one or more pockets 38 located on either the interior or exterior of the backpack for storing extra filter bags, sanding discs, tools, or pneumatic sander parts such as different backup pads. The backpack 10 can further include a hook 40 connected to the lower half of the backpack for attaching the pneumatic sander to the backpack when not in use.

Suitable filter bags 11 for use with the backpack 10 are disclosed in pending U.S. patent application Ser. No. 12/180,712 entitled "Dust collection Device For Sanding Tool" claiming priority to U.S. provisional application 60/969,808 and in pending PCT patent application number US2009/043964 entitled "Dust collection Device For Sanding Tool" claiming priority to U.S. provisional application No. 61/016,854. The filter bag 11 generally includes one or more layers of filter media, such as nonwoven materials, forming an enclosed volume and a coupler attached to the filter bag to connect the filter bag to the vacuum hose 23. In some embodiments, the filter bag 11 includes an internal sleeve that acts as a pre-filter, and the internal sleeve has a bypass mode such that exhaust air does not have to pass through the sleeve before passing through the sidewall of the filter bag.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in a consistent manner. In the event of inconsistencies or contradictions between the incorporated references and this application, the information in the preceding description shall control. The preceding description in order to enable one of ordinary skill in the art to practice the claimed invention is not to be construed as limiting the scope of the invention, which is defined by the claims and all equivalents thereto.

What is claimed is:

1. A combination comprising a backpack, a vacuum hose, and a filter bag; the backpack comprising a backpack strap, a back panel, an interior compartment, and an opening into the interior compartment located in the back panel; and wherein the opening is positioned to direct exhaust air from the filter bag located in the interior compartment onto a person's back during use.

2. The combination of claim 1 wherein the opening comprises a first mesh panel.

3. The combination of claim 1 comprising a flow control device for regulating the volume of exhaust air passing through the opening.

4. The combination of claim 3 wherein the flow control device comprises a flap secured to the back panel for selectively opening or closing the opening.

5. The combination of claims 1, 2, 3, or 4 comprising a second mesh panel located in the backpack.

6. The combination of claim 5 wherein the second mesh panel is located in the lower ½ of the backpack's height, H.

7. The combination of claim 5 comprising a flow control device for regulating the volume of exhaust air passing through the second mesh panel.

8. The combination of claim 1 wherein the backpack comprises a material having an air permeability of less than about 100 $ft^3/min/ft^2$.

9. The combination of claim 8 wherein the backpack comprises a material having an air permeability of 0 $ft^3/min/ft^2$.

10. The combination of claims 1, 2, 8, or 9 wherein the opening comprises an open area and the open area is greater than 20 $cm^2$.

11. The combination of claim 2 wherein the first mesh panel comprises a material having an air permeability of greater than about 250 $ft^3/min/ft^2$.

12. The combination of claim 1 comprising a vacuum hose aperture and the vacuum hose aperture is located in the upper ½ of the backpack's height, H.

13. The combination of claim 12 comprising a top panel and the vacuum hose aperture is located in the top panel.

14. The combination of claim 12 comprising a vacuum hose strap attached to the backpack strap.

15. The combination of claim 14 wherein the backpack strap comprises a shoulder strap.

* * * * *